United States Patent [19]

Watanabe et al.

[11] 4,299,503

[45] Nov. 10, 1981

[54] CHARACTER SELECTION MECHANISM FOR A TYPEWRITER

[75] Inventors: Tomoyoshi Watanabe; Toshio Nakai; Susumu Kuzuya; Hiroshi Onoda; Akira Asai; Takayuki Iwase; Kazuo Nakamura, all of Nagoya, Japan

[73] Assignee: Brother Kogyo Kabushiki Kaisha, Aichi, Japan

[21] Appl. No.: 65,145

[22] Filed: Aug. 7, 1979

[30] Foreign Application Priority Data

Aug. 12, 1978 [JP] Japan ..... 53-110729[U]

[51] Int. Cl.[3] ..... B41J 7/34; B41J 1/60

[52] U.S. Cl. ..... 400/161.5; 400/378; 400/368

[58] Field of Search ..... 400/161.5, 161.1, 161, 400/378, 379, 368, 371, 666

[56] References Cited

U.S. PATENT DOCUMENTS

| | | | |
|---|---|---|---|
| 3,239,049 | 3/1966 | Voit, Jr. | 400/161.5 |
| 3,605,978 | 9/1971 | Kawano | 400/161.5 |
| 3,666,070 | 5/1972 | Schaefer | 400/161.5 |
| 3,677,384 | 7/1972 | Link | 400/161.5 |
| 3,721,327 | 3/1973 | Werf et al. | 400/666 |
| 3,814,228 | 6/1974 | Blum | 400/368 |
| 3,930,569 | 1/1976 | Boyden | 400/161.5 |
| 3,967,715 | 7/1976 | Kohlhage et al. | 400/161.5 |
| 3,981,386 | 9/1976 | Abell, Jr. et al. | 400/161.5 |
| 4,023,665 | 5/1977 | Boyden | 400/161.5 |

*Primary Examiner*—William Pieprz

*Attorney, Agent, or Firm*—Browdy and Neimark

[57] ABSTRACT

A character selection mechanism for a typewriter having a single type head with characters arranged in rows and columns thereon, which mechanism comprises, for either row selection and column selection similarly, a series of cams, a series of cam followers, a series of transmitting members, and an output member, as one set. The cams are fixed on a cam shaft which is rotated once in response to depressing of any one key. Each of the cam followers is rotated by each corresponding cam and is shifted, against a biasing force, by each corresponding transmitting member from a first position to a second position in response to depressing of the corresponding key. The cam follower engages the output member at the second position for controlling its operation based on the rotation of the cam shaft. The output member is connected to the type head via a connecting mechanism.

6 Claims, 14 Drawing Figures

CHARACTER SELECTION MECHANISM FOR A TYPEWRITER

BACKGROUND OF THE INVENTION

This invention relates to a character selection mechanism in a typewriter and more particularly to an improvement of a character selection mechanism wherein a single type head having a multitude of characters disposed in order on a spherical peripheral surface thereof in rows and in columns is rotated and tilted to select one character desired.

As a character selection mechanism of this sort there are known various aggregate motion mechanisms, for example as described in the specification and drawings of U.S. Pat. No. 2,879,876, in which a large number of movable pulleys are biased by rotate or tilt cams; that is, the selection of character is made by the so-called aggregate pulley motion mechanism. However, in an aggregate motion mechanism using a large number of moving parts like movable pulleys, there has been a problem in point of sureness of operation.

SUMMARY OF THE INVENTION

It is a primary object of this invention to provide a novel character selection mechanism which can guarantee a positive operation thereof by means of selecting character without using an aggregate motion mechanism.

It is another object of this invention is attain the above-mentioned purpose at a lowest possible manufacturing cost and with a simplest possible structure.

The invented mechanism for a typewriter having a single type head which contains characters arranged in rows and columns characteristically comprise (a) a plurality of key levers; (b) a plurality of interposers movably supported under the key levers, each of them being depressed by each key lever respectively; (c) a continuously rotating drive shaft; (d) a cam shaft being connected through a clutch to the drive shaft for driving it in a single cycle operation each time when the clutch is triggered upon a depression of each of the key levers; (e) series of cams fixed on the cam shaft; (f) a common drive member mounted transversely under all of the interposers and being operatively connected with the cam shaft for being synchronously moved with the cam shaft, the common drive member actuating the depressed interposer toward an operative position; (g) a series of cam followers assigned individually one to each of the cams and being movably supported between a first position and a second position, each of the cam followers normally held in the first position by a spring; (h) a series of transmitting members assigned individually one to each of the cam followers, each of the transmitting members being corresponding to at least one interposer, and each of the transmitting members movably supported for moving the cam follower from the first position to the second position against the spring when one of interposers is moved to the operative position; (i) output means being operatively connected with the cam follower moved to the second position and being actuated by the cam follower upon a rotation of the cam corresponding thereto; and (j) connecting means for connecting the output means with the type head to select the character of the type head in response to the movement of the cam follower moved to the second position.

BRIEF DESCRIPTION OF THE DRAWINGS

The accompanying drawings illustrate a typewriter embodying the present device, in which.

DETAILED DESCRIPTION OF A PREFERRED EMBODIMENT

Figure 1:
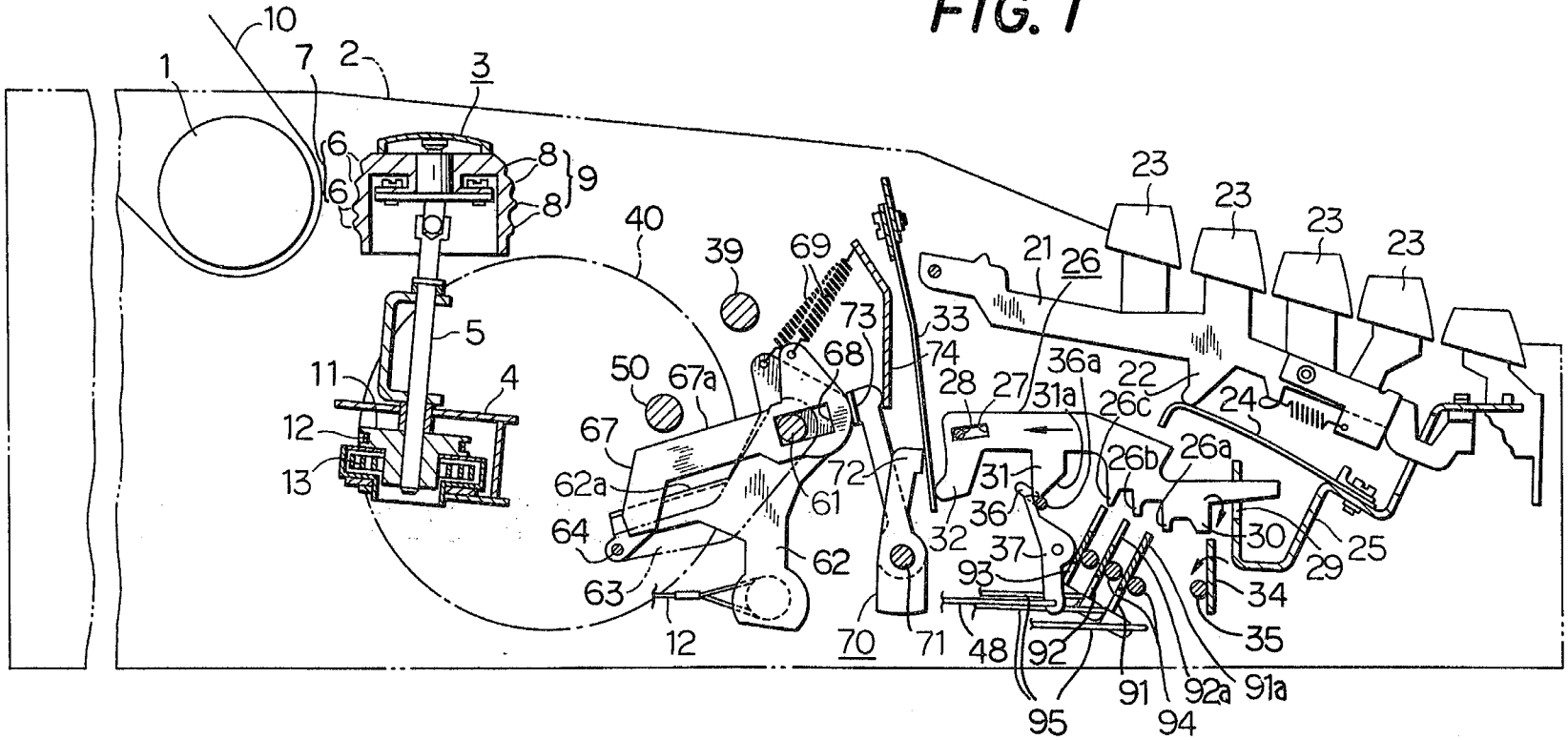
FIG. 1 is a sectional view of principal mechanisms of the typewriter.

With reference to the appended drawings a preferred embodiment will be described hereunder. This invention should not be interpreted to be limited to this embodiment, which is disclosed only by way of example for better understanding.

Referring first to a printing mechanism, the reference numeral 1 in the drawings is a platen mounted on a carriage (not shown), which carriage is mounted horizontally movably in the rear (left in FIG. 1) of a machine frame 2. A type head 3 is carried on a supporting member 4 through a type head supporting shaft 5 in front of the platen 1, and it has a spherical peripheral surface which is divided in two by a vertical plane therethrough, on one half portion of which are disposed eleven columns 7 of small character types at equal intervals, in each said column being embossed four small character types 6 in rows, while on the other half portion of the peripheral surface are disposed eleven columns 9 of large character types at equal intervals each of which also contains four large character types 8 embossed in rows. As shown in FIG. 2, among the small character columns 7, the centrally located character column (hereinafter referred to as the (0) character column) is normally confronted to the platen 1, and the second row (from the top) of the small characters 6, which row will hereinafter be referred to as the (0) character row, is confronted to the platen 1.

In response to a key selecting operation as will be described hereinafter, the type head 3 performs only a tilting motion (a character selecting motion in the perpendicular direction to character rows 14 (see FIG. 14) by a vertical pivotal movement) when a key corresponding to a character 6 in the (0) character column 7 of small characters is operated for selection, and after selecting the character 6 it performs a printing action toward the platen 1. On the other hand, when a key corresponding to a small character 6 in other column than the (0) character column 7 is operated for selection, the type head 3 performs a rotating motion by the required amount to either the right or left from the position of the (0) character column 7 to select the desired character column 7, and at the same time it performs a tilting motion either up or down to select the character 6 in the selected character column 7, then it performs a printing action to a typing paper 10 on the platen 1.

Furthermore, the type head 3 is constructed so that when a shift key (not shown) is operated, the large character columns 9 come to confront to the platen 1. Besides, the large characters 8 are disposed so as to be in axial symmetry with the corresponding small characters 6 relative to the rotational axis of the type head 3. Therefore, by operating a shift key and effecting the above-mentioned selective operation of a key, a character selecting motion is carried out in the same manner as mentioned above and the large character 8 corresponding to the key which has been operated for selection is printed.

Five character columns 7 arranged in one direction from the (0) type column 7 of small characters are herein taken to be (+1) to (+5) character columns 7 in order of the arrangement, and five character columns 7 continuous in the other direction therefrom are herein taken to be (−1) to (−5) character columns 7. This is also the case with the large character columns 9. Furthermore, the character row above the (0) character row 14 is taken to be (+1) character row, while the character rows thereunder are taken to be (−1) and (−2) character rows 14 in order of arrangement.

A take-up pulley 11 is fixed to the lower end of the print head supporting shaft 5, and one end of a rotate string 12 is wound thereon. By drawing out the rotate string 12, the type head 3 is rotated in the direction in which the (+1) to (+5) character columns 7, 9 are confronted to the platen 1. Disposed beneath the take-up pulley 11 is a spiral spring 13 which biases the take-up pulley 11 in the winding direction of the rotate spring 12, that is, biases the type head 3 in the direction in which the (−1) to (−5) character columns 7, 9 are confronted to the platen 1. Consequently, by winding or drawing out the rotate string 12 with respect to the take-up pulley 11 by or against the bias of the spiral spring 13, the type head 3 can be selectively rotated to either the right or left from the position of the (0) character column 7 or 9 confronted to the platen 1.

Figure 14:
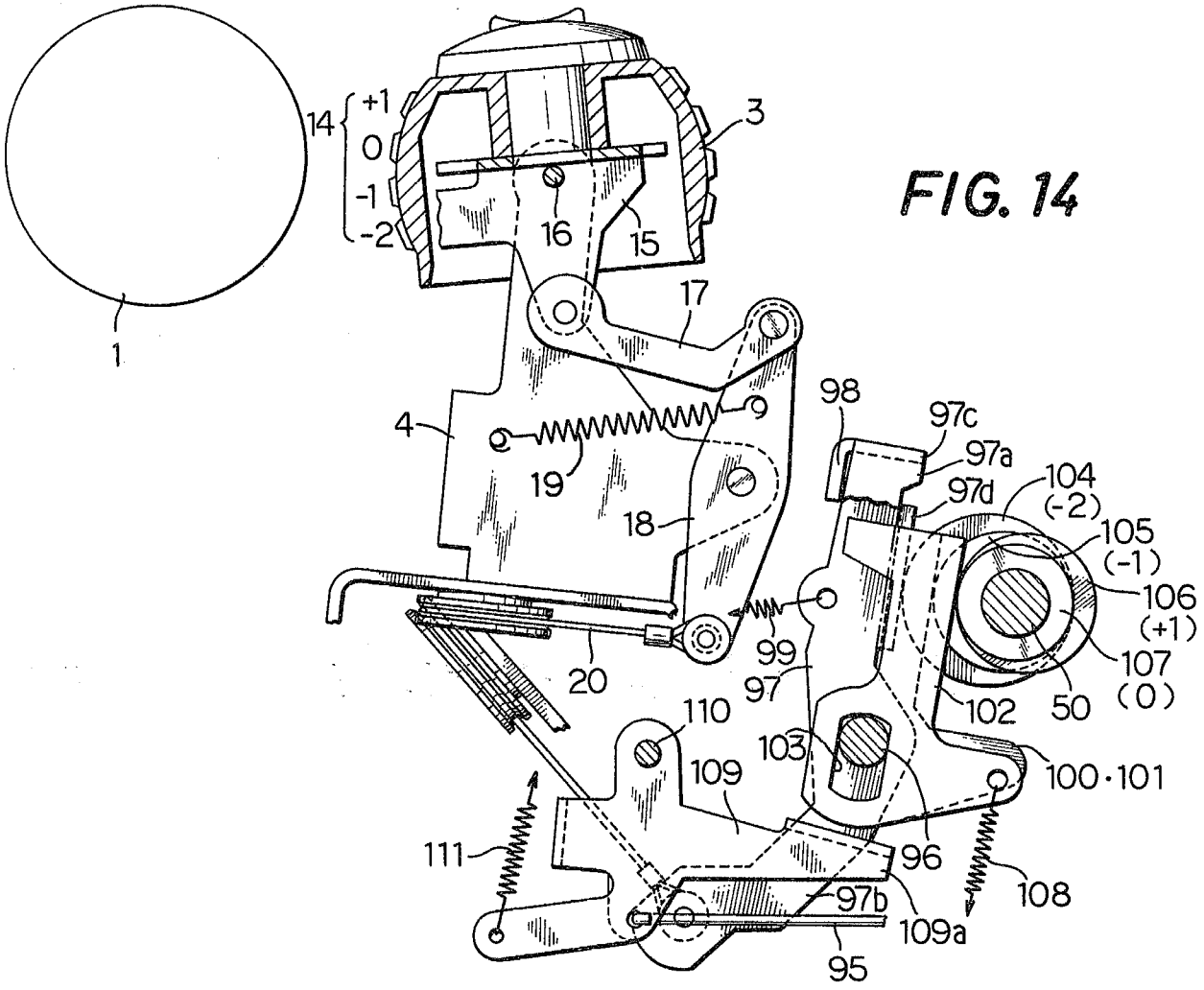
FIG. 14 is a sectional view of principal portions showing part of the tilt selection mechanism.

The type head 3, which is carried on the print head supporting shaft 5 as previously explained, is made capable of effecting a rocking motion relative to the supporting shaft 5 by the known universal joint mechanism. And the printing head 3 is mounted on a tilt member 15 which, as shown in FIG. 14, is carried on the supporting member 4 through a short shaft 16 for rocking motion in a vertical plane.

The lower end of the tilt member 15 is pivoted to the rear end of a connecting rod 17 the front end of which is pivoted to the upper end of a tilt link 18. The tilt link 18 is pivotably supported by the supporting member 4 at a nearly central part thereof and is tensionally loaded in a counterclockwise direction in FIG. 14 by means of a spring 19 stretched between the tilt link 18 and the supporting member 4. To the lower end of the tilt link 18 is connected one end of the tilt string 20, the other end of which is connected to a tilt selection mechanism as will be described hereinafter through two pulleys which are pivotably supported on the supporting member 4.

In normal condition the tilt selection mechanism is set so that the (0) character row 14 of the type head 3 is confronted to the platen 1. When the tilt selection mechanism is operated for selection and the tilt string 20 is thereby pulled by a required amount in the direction against the spring 19, the tilt link 18 rotates by a required amount in a clockwise direction in FIG. 14, allowing the type head 3 to effect a tilting motion through the connecting rod 17 and the tilt member 15, whereby the (+1) character row 14 of the printing head 3 is brought into an confronted relation to the platen 1.

On the other hand, when the tilt selection mechanism is operated for selection to allow the tilt string 20 to loosen by the same amount as the aforesaid, required pulling amount, the tilt link 18 is rotated in a counterclockwise direction by a required amount due to the biasing force of the spring 19, allowing the printing head 3 to perform a tilting motion through the connecting rod 17 and the tilt member 15, whereby the (−1) character row 14 is brought into an confronted relation to the platen 1. In the same way, when the tilt string 20 is loosened twice the foregoing amount, the type head 3 is tilted so that the (−2) character row 14 comes to confront to the platen 1.

The following is an explanation of the printing clutch mechanism and the operation mechanism for driving the type head 3.

Figure 2:
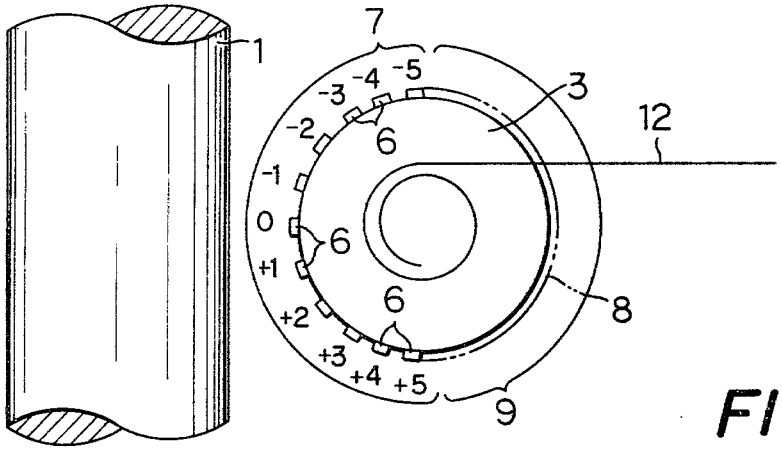
FIG. 2 is a schematic plan view showing the relation of arrangement of type columns.
Figure 3:
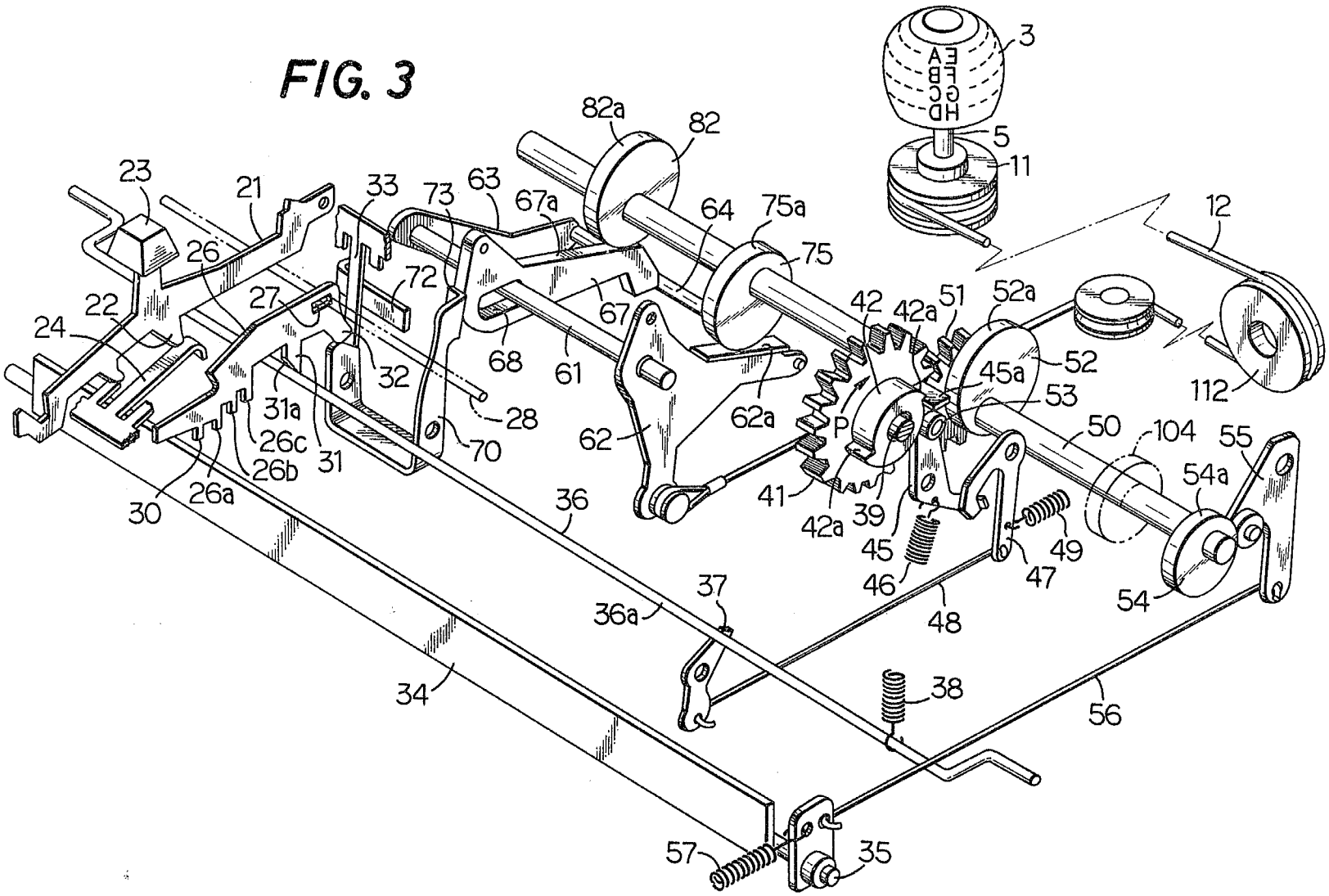
FIG. 3 is a perspective view of principal mechanisms.

In FIGS. 1 and 3, a large number of key levers 21 are disposed in the front portion of the machine frame 2 and have each a depressing lug 22 which projects downwardly from the lower surface thereof. A key 23 is fixed to each of the key levers 21. An operating plate 24 positioned under each of the key levers 21 is formed of a comb tooth-shaped spring material the front end of which is secured to a front machine frame 25, with the rear end thereof in the form of a comb tooth being contacted to the depressing lug 22 and bent downwardly at nearly a right angle. The operating plate 24 is constructed so that upon depression of the key lever 21 the rear end portion of the operating plate is depressed downwards against its own resilience by the depressing lug 22 of the said key lever 21.

An interposer 26 is disposed beneath each operating plate 24 in confronted relation thereto, and is provided at an upper portion of its rear end with a longitudinally extending elongated through hole 27. Through the elongated hole 27 the interposer 26 is supported for longitudinal and pivotal movement by a mounting shaft 28 which extends across the machine frame 2, so that the downward movement of the operating plate 24 allows the front end portion of the interposer 26 to pivot downwards about the mounting shaft 28. Four interposers 26 form one set and the interposers 26 are disposed set by set in parallel in the order of arrangement of the character columns 7, 9, and in each set the four interposers 26 are disposed in the order of arrangement of the four characters 6, 8 in the character columns 7, 9, respectively. The reference numerals 26*a*, 26*b* and 26*c* are projections formed downwardly in the front of the interposer 26.

A driver lug 30 is formed downwardly on the lower surface of the front end portion of the interposer 26, and an engaging lug 31 projects downwards from the lower surface of an intermediate part of the interposer 26. In the lower end portion of the engaging lug 31 is formed a cam face 31*a* which inclines in the front direction. A pressure lug 32 projects downwardly and somewhat rearwardly at the rear end of the interposer 26. A restriction hole 29 is formed through the front machine frame 25, through which is inserted the front end portion of the interposer 26 so as to be movable in the vertical and longitudinal directions, and the interposer 26 is thereby restricted to the motion on a single plane.

An interposer return spring 33 is fixed at an upper end portion thereof to the machine frame 2 so as to be corresponded to each interposer 26, with the lower end thereof being in abutment with the pressure lug 32 of each interposer 26 whereby the latter is biased in a counterclockwise direction in FIG. 1 about the mounting shaft 28, and normally, that is, when the interposer is in inoperative position, the front end of the interposer 26 is engaged with the upper end of the restriction hole 29 so that it is held in the up-position.

A drive plate 34 is fixed to a supporting shaft 35 pivotably extends below the front end of the interposer 26. The drive plate 34 is normally in an upright state and is adapted to pivot at a predetermined angle to the rear from the upright state and then pivotally return to the front, its arrangement being such that when the interposer 26 is moved downwards in an operative position through the operating plate 24 upon depression of the key 23, the driven lug 30 is positioned within the pivotal locus of the drive plate 34.

A clutch control rod 36 is disposed so as to cross below the intermediate portion of the interposer 26. As shown in FIG. 3, the end portions of the clutch control rod 36 are bent so that the intermediate portion thereof projects to the front to form an engaging part 36*a*, with the engaging part 36*a* being contacted to the engaging lugs 31 of the interposers 26 so that when one of the interposes 26 moves downwards the engaging part 36*a* is swung downwards by the engaging lug 31. A clutch control lever 37 is intermediately journalled so that the upper end thereof is in abutment with a part of the engaging portion 36*a* of the clutch control rod 36 and so that the downward movement of the engaging part 36*a* causes the upper end of the clutch control lever 37 to pivot rearwards. A spring 38 biases the engaging part 36*a* upwards.

Next, an explanation is given below about the printing clutch mechansim.

Figure 4:
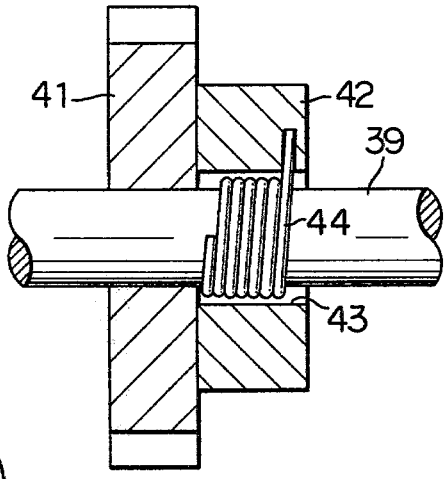
FIG. 4 is a sectional view of a spring clutch.

A drive shaft 39 is connected through a suitable connecting mechanism (not shown) to a drive motor 40 mounted on one side of the typewriter so that the drive shaft 39 rotates in the direction of the arrow P, and on the outer periphery of one end portion thereof is idly carried a first gear 41. A clutch member 42 is fixed to one side of the first gear 41 and is provided on its outer periphery with two clutch pawls 42*a* spaced from each other at an interval of 180-deg. As shown in FIG. 4, moreover, the clutch member 42 has a centrally formed through hole 43 through which extends the drive shaft 39. A clutch spring 44 is fitted on the drive shaft within the through hole 43, one end of which is tightly wound around the drive shaft 39 in the rotational direction thereof and the other end of which is secured to the clutch member 42, so that when the clutch member 42 is latched only the drive shaft 39 rotates regardless of the clutch member 42 and the first gear 41, while when the clutch member 42 is unlatched the rotation towards the arrow P of the drive shaft 39 is transmitted to the clutch member 42 and the first gear 41.

A clutch lever 45 is pivoted at the middle portion thereof and is provided at the upper end thereof with a clutch engaging part 45*a* which is engageable with the clutch pawl 42*a*. When the clutch engaging part 45*a* engages the clutch pawl 42*a*, the pivotal movement of the clutch member 42 in the direction of the arrow P is stopped. A holding lever 47 is also pivoted at the middle portion thereof, one end of which engages the lower end of the clutch lever 45 to keep the engaged condition between the clutch lever 45 and the clutch pawl 42*a*. And the other end of the holding lever 47 is connected to the lower end of the clutch control lever 37 by a connecting rod 48 whereby when the clutch control lever 37 is pivotally moved in a counterclockwise direction in FIG. 1 by a downward movement of the engaging part 36*a* of the clutch control rod 36, the clutch lever 45 and the clutch pawl 42*a* are disengaged from each other. A spring 46 biases the clutch lever 45 in the direction of engagement with the holding lever 47 and in the direction of disengagement from the clutch pawl 42*a*. A spring 49 biases the holding lever 47 in the direction of engagement with the clutch lever 45 and also biases the clutch control lever 37 in the direction of engagement with the clutch control rod 36.

A cam shaft 50 is rotatably disposed in parallel to the drive shaft 39, and onto the outer periphery thereof is fixed a second gear 51 which meshes with the first gear 41 and is adapted to rotate fully once for each half rotation of the first gear 41. A return cam 52 is secured to the cam shaft 50 adjacent the second gear 51 and has a peripheral cam face 52*a* which is in abutment with a cam follower 53, the cam follower 53 being rotatably attached to the clutch lever 45, so that the rotation of the cam shaft 50 causes the clutch lever 45 to pivotally moved through the cam follower 53 in the direction of engagement with the clutch pawl 42*a* and the holding lever 47.

A drive cam 54 is mounted on one end of the cam shaft 50 and a cam follower 55 thereof is connected to the supporting shaft 35 through a connecting rod 56. Normally, through the cam follower 55 and the connecting rod 56, the driving cam 54 holds the drive plate 34 in upright position, while one rotation thereof causes the drive plate 34 to rotate at a predetermined angle to the rear from the upright condition and then return to the upright condition. A spring 57 biases the cam follower 55 in the direction in which the latter is in contact with the cam face 54*a* of the drive cam 54.

Figure 5:
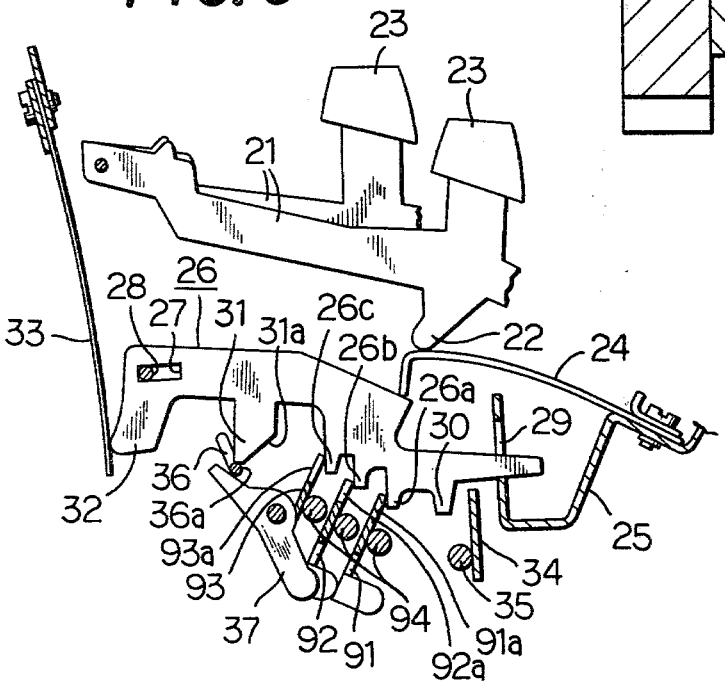
FIG. 5 is a sectional view showing a depressed state of a clutch control rod.

Now, when any key 23 is operated for selection to depress the key lever 21, as illustrated in FIG. 5, the interposer 26 corresponding to the said key 23 is forced down through the operating plate 24, so that the engaging part 36*a* of the clutch control rod 36 is moved downwards by the engaging lug 31 of the interposer 26 and the clutch control lever 37 is pivoted in a counterclockwise direction in FIGS. 1 and 5. Consequently, the holding lever 47 connected through the connecting rod 48 to the lower end of the clutch control lever 37 is pivoted in the direction of disengagement from the clutch lever 45 and the clutch engaging part 45*a* of the clutch lever 45 is disengaged from the clutch pawl 42*a* of the clutch member 42 due to the biasing force of the spring 46.

Figure 6:
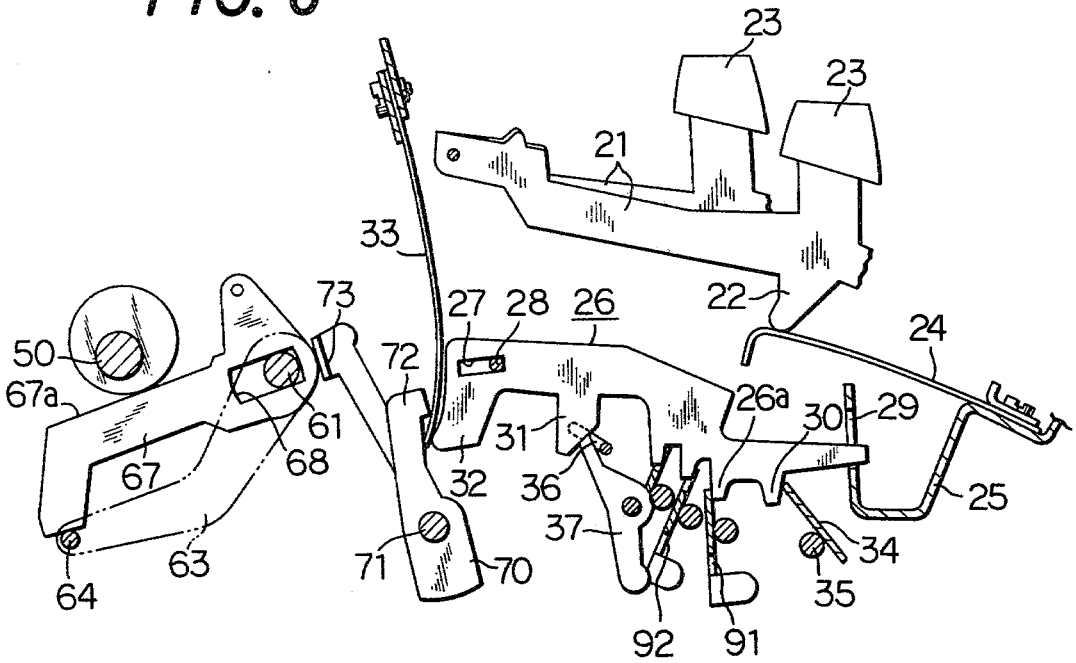
FIG. 6 is a sectional view showing a receded state of an interposer.

The clutch member 42 is now free, so the rotation of the drive shaft 39 in the direction of the arrow P is transmitted to the clutch member 42 and the first gear 41, so that the cam shaft 50 is rotated via the second gear 51 in mesh with the first gear 41, allowing the drive cam 54 at the end of the cam shaft 50 to be rotated. Consequently, as illustrated in FIG. 6, the drive plate 34 rotates to the rear via the cam follower 55 and the connecting rod 56 and engages the driven lug 30 of the interposer 26, allowing the latter to move rearwards, so that the interposer 26 causes the corresponding interposer return spring 33 to bend rearwards against the resilience thereof, resulting in that a rotate selection mechanism as will be described hereinafter is operated. The rearward movement of the interposer 26 also causes a tilt selection mechanism as will be described hereinafter to operate.

When the interposer 26 moves rearwards, the engaging lug 31 thereof and the clutch control rod 36 are disengaged from each other, and the latter is returned to its upper position by virtue of the biasing force of the spring 38.

Figure 7:
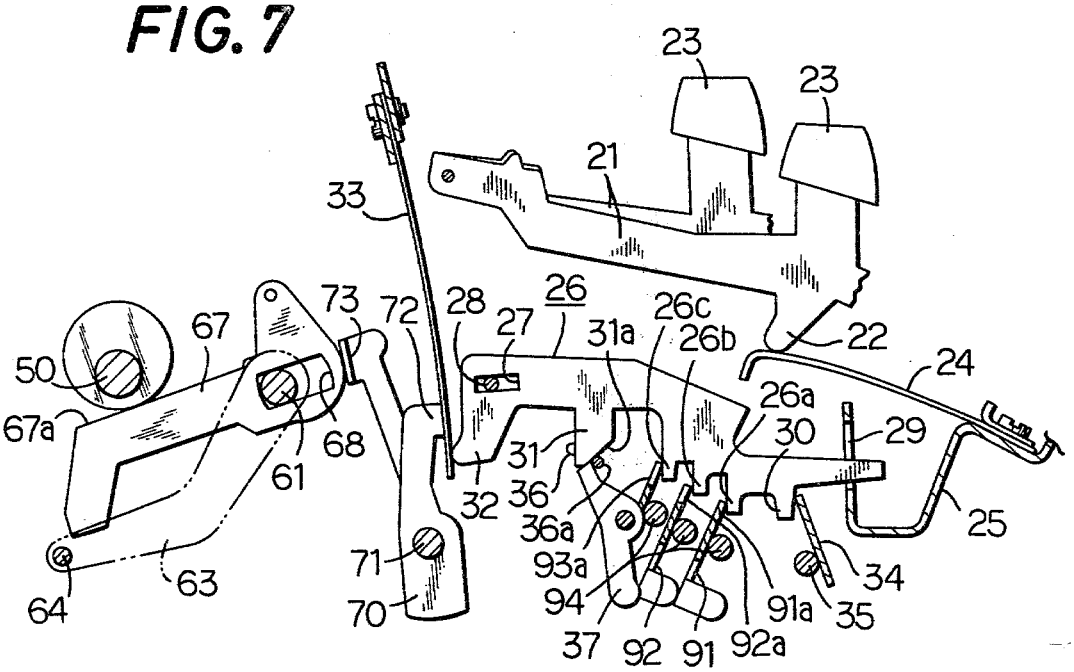
FIG. 7 is a sectional view showing a returned-to-front state of the interposer.

And when the cam shaft 50 has rotated once allowing the drive cam 54 to also rotate once, the drive plate 34 is again returned upright toward the front via the cam follower 55 and the connecting rod 48 with the result that, due to the biasing force of the interposer return spring 33, the interposer 26 follows the drive plate 34 and returns to the front with the driven lug 30 in engagement with the drive plate 34. In this case, as previously explained, the clutch control rod 36 already returns to the up-position and the engaging part thereof 36*a* is within the range of return movement of the engaging lug 31 of the interposer 26, but at the lower end of the engaging lug 31 there is formed the cam face 31*a* which inclines to the front, and then when the interposer 26 returns to the front, the engaging lug 31 can slantly slide forward-up, at its cam face 31*a*, along the engaging part 36*a* of the clutch control rod 36 as illustrated in FIG. 7, and hence the forward-up movement of the interposer 26 is not impeded by the clutch control rod 36 and the interposer 26 returns positively to the position shown in FIG. 1.

On the other hand, upon upward return of the clutch control rod 36, the clutch control lever 37 is moved following the clutch control rod 36 due to the biasing force of the spring 49, so that the holding lever 47 connected through the connecting rod 48 to the clutch control lever 37 is returned to the position of engagement with the clutch lever 45 due to the biasing force of the spring 49. And the rotation of the return cam 52 caused by the rotation of the cam shaft 50 allows the clutch lever 45 to pivot in the direction of engagement with the clutch pawl 42*a* and the holding lever 47 and the clutch lever 45 is latched by the holding lever 47 in the engageable position, resulting in that the clutch pawl 42*a* of the rotating clutch member 42 becomes engaged with the clutch engaging part 45*a* of the clutch lever 45 and the first gear 41 stops after rotation by half. Consequently, the cam shaft 50 connected via the first and second gears 41, 51 to the drive shaft 39 rotates once and stops. Now the operation based on a single operation of the key 23 is over.

Next, an explanation is given about the rotate selection mechanism. A rotate supporting shaft 61 is pivotably mounted between the cam shaft 50 and the interposer return spring 33. As shown in FIG. 3, onto the rotate supporting shaft 61 are secured the intermediate portion of a generally L-shaped non-selection cam follower 62 and the front end portion of a supporting lever 63 so that both are spaced from each other. Between the rear end of the non-selection cam follower 62 and that of the supporting lever 63 is mounted a rotate output bar 64. To the lower end of the non-selection cam follower 62 is attached an end portion of the rotate string 12. Consequently, the non-selection cam follower 62 and the rotate output bar 64 are upwardly biased by the spiral spring 13 through the rotate string 12, and by pivoting the non-selection cam follower 62 and the rotate output bar 64 upwards or downwards, the type head 3 can be rotated to the (−) or (+) side via the rotate string 12.

Figure 10:
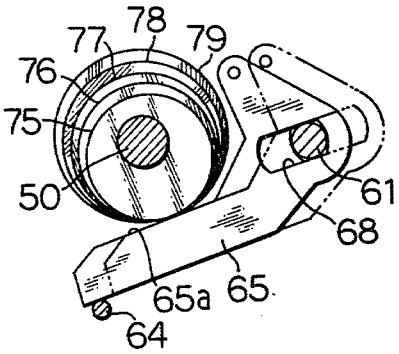
FIG. 10 is a sectional view showing the relation between (−) side rotate cam followers and (−) side rotate cams.
Figure 11:
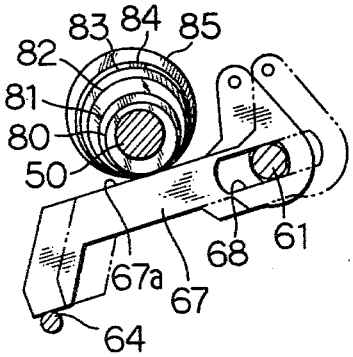
FIG. 11 is a sectional view showing the relation between (+) side rotate cam followers and (+) side and (0) rotate cams.

The reference numerals 65, 66 and 67 designate a total of four (−) side rotate cam followers, one (0) rotate cam follower and a total of five (+) side rotate cam followers, respectively, which are mounted on the rotate supporting shaft 61 for longitudinal and pivotal movement between the non-selection cam follower 62 and the supporting lever 63 and through the respective elongated holes 68 each formed in the lower portion of the front end so as to move between a first position and a second position. As illustrated in FIGS. 10 and 11, their movement from the first position to the second position causes the lower surfaces of the rear (left in FIGS. 10 and 11) ends to engages with the upper surface of the rotate output bar 64. A spring 69 shown in FIG. 1 biases the rotate cam followers 65–67 and the non-selection cam follower 62 in the direction of contact with rotate cams 75–85 as will be described hereinafter, and besides it biases the rotate cam followers 65–67 in the first position shown in FIG. 1 with respect to the rotate supporting shaft 61.

Rotate transmitting members 70, which are provided ten in all, are pivotably mounted on the mounting shaft 71 which extends below of the rotate cam followers 65–67. Each rotate transmitting member is provided with an abutting plate portion 72 confronted to the interposers 26 corresponding to the other type columns 7 than the (−5) type column 7 which is a non-selection type column of the printing head 3, and extruding portion 73 in abutment with the front end of the rotate cam follower. That is, the abutting plate portion is confronted to four interposers 26, with four interposer return springs 33 corresponding to the four interposers 26 interposed therebetween, and when any of the four interposer return springs 33 bends backwards, the corresponding rotate transmitting member 70 is pivoted backwards whereby the corresponding rotate cam follower of 65–67 is moved to the rear. A stopper portion 74 shown in FIG. 1 is disposed behind the rotate transmitting member 70 to restrict the forwardly pivoting position of the latter.

The four (−) side rotate cam followers 65 are corresponded via the rotate transmitting members 70 to the interposers 26 corresponding to the (−4) to (−1) character columns 7 and 9. The (0) rotate cam follower 66 is corresponded via the rotate transmitting member 70 to the interposers 26 corresponding to the (0) character columns 7 and 9. Furthermore, the five (+) side rotate cam followers 67 are corresponded via the rotate transmitting member 70 to the interposers 26 corresponding to the (+1) to (+5) character columns 7 and 9. On the other hand, the non-selection cam follower 62 is corresponded to the interposers 26 corresponding to the (−5) character columns 7 and 9 without the medium of the rotate transmitting member 70 for which reason it is termed "non-selection".

A first (−) side rotate cam 75 is fixed onto the cam shaft 50 so as to be confronted to the non-selection cam follower 62. Normally, as shown in FIG. 3, a cam follower portion 62*a* of the non-selection cam follower 62 is kept in contact with a part of peripheral cam face 75*a*, where the part is most alienated from the axis of the cam shaft 50, by virtue of the biasing force of the spiral spring 13 and spring 69. Therefore, the non-selection cam follower 62 assumes the position shown in FIG. 3. When the first (−) side rotate cam 75 is rotated by the rotation of the cam shaft 50, the non-selection cam follower 62 is largely rotated and the type head 3 is rotated in the direction in which its (−) side character columns 7 or 9 is confronted to the platen 1. The first (−) side rotate cam 75 normally causes the (0) character column 7 or 9 of the printing head 3 to be confronted to the platen 1, and its lift amount (distance different between the farthest and nearest portions of the cam face from the axis of the cam shaft 50) is such that the type head 3 is rotated when the cam 75 rotates, until the (−5) character column 7 or 9 comes to be confronted to the platen 1.

Figure 12:
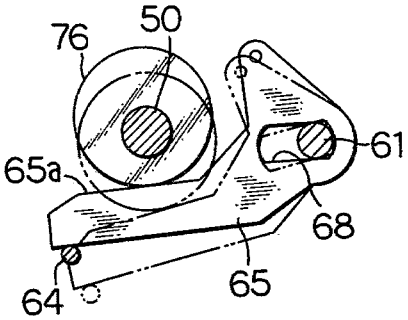
FIG. 12 is a sectional view showing downwardly pivoted state of a (−) side rotate cam follower.

Second to fifth (−) side rotate cams 76–79 are secured onto the cam shaft 50 so as to be confronted to each of the (−) side rotate cam followers 65. In respect to the distance of portions of the peripheral cam faces of those cams 76–79 from the axis of the cam shaft 50, the distance of the farthest portions are all equal to that of the first (−) side rotate cam 75, but the distance of the nearest portions is made progressively larger in the order of the numerals of the cams growing larger. The cam follower portion 65*a* of each of the (−) side rotate cam followers 65 is contacted, by the action of the spring 69, the most alienated part of the rotate cams 76–79 from the axis of the cam shaft 50, and each (−) side cam follower 65 normally assumes the same up-position and is spaced forwards from the rotate output bar 64. When, as illustrated in FIG. 12, any of the rotate cam followers 65 moves rearwards and the lower surface of its end comes to engage with the upper surface of the rotate output bar 64, the rotation of the second to fifth rotate cams 76–79 upon rotation of the cam shaft 50 cause the rotate cam followers 65 to be rotated upwards according to the lift amount of the corresponding cams of the second to fifth rotate cams 76–79, so that the type head 3 is rotated from (0) to (−) side in the same manner as mentioned above. The second to fifth rotate cams 76–79 have the respective lift amounts such that the type head 3 is rotated from the (0) position to (−4) to (−1) positions.

A (0) rotate cam 80 is secured onto the cam shaft 50 so as to be confronted to the (0) rotate cam follower 66. With a cam face 80*a* nearly concentric with the cam shaft 50 is kept in contact with a cam follower portion 66*a* of the (0) rotate cam follower 66 by virtue of the biasing force of the spring 69. Even when the cam shaft 50 rotates in a receded condition of the (0) rotate cam follower 66, the rotate output bar 64 is not rotated.

Figure 13:
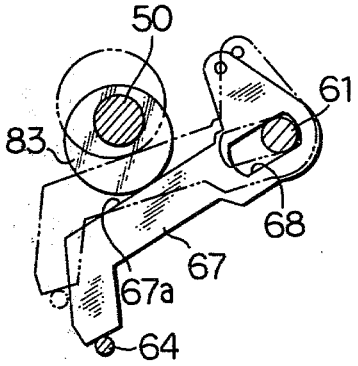
FIG. 13 is a sectional view showing a downwardly pivoted state of a (+) side rotate cam follower.

First to fifth (+) side rotate cams 81–85 are secured onto the cam shaft 50 so as to be confronted to each of the first to fifth (+) side rotate cam followers 67. In respect to the distance of portions of the peripheral cam face of those cams from the axis of the cam shaft 50, the distance of the nearest portions are all equal to that of the (0) rotate cam 80, but the distance of the farthest portions is made progressively larger in the order of the numerals of the cams growing larger. That is to say, all of the nearest portions of the cam faces of the rotate cams 80–85 to the axis of the cam shaft 50 are aligned on one line parallel to the axis of the cam shaft 50. The cam follower portion 67*a* of each of the (+) side rotate cam followers 67 is contacted, by the action of the spring 69, the nearest part of the rotate cams 80–85 to the axis of the cam shaft 50, and each (+) side rotate cam follower 67 normally assumes the same up-position and is spaced forwards from the rotate output bar 64. When, as illustrated in FIG. 13, any of the rotate cam followers 67 moves rearwards and the lower surface of its end engages the upper surface of the rotate output bar 64, the rotation of the first to fifth rotate cams 81–85 causes the rotate cam followers 67 to be pivoted downwards according to the lift amount of the corresponding cam of the first to fifth rotate cams 81–85, so that, contrary to the foregoing, the type head 3 is rotated from the (0) character column 7 or 9 to (+) side. The first to fifth rotate cams 81–85 have the respective lift amounts such that the type head 3 is rotated to (+1) to (+5) positions.

Therefore, when the key 23 corresponding to the (−5) character columns 7 and 9 of the type head 3 is depressed, the interposer 26 corresponding to the said key 23 is depressed and then moved back, but the interposer 26 corresponding to the (−5) character columns 7 and 9 causes none of the rotate transmitting members 70 to move.

Consequently, even when the rotate cams 76–85 are rotated by the rotation of the cam shaft 50, the action of the cams 76–85 is not transmitted to the rotate output bar 64, so that the non-selection cam follower 62 is rotated upwards by the (−5) amount according to the lift amount of the first rotate cam 75 without being impeded its upward rotational movement and the type head 3 is rotated from the position of the (0) character column 7 or 9 to the position in which the (−5) character column 7 or 9 is confronted to the platen 1.

And when the cam shaft 50 has rotated fully once, the non-selection cam follower 62 is again depressed by the first rotate cam 75 and the (0) character column 7 of the type head 3 comes to be confronted to the platen 1.

Next, when the key 23 corresponding to any of the (−4) to (−1) character columns 7 and 9 is depressed, the interposer 26 corresponding thereto moves rearwards and the interposer return spring 33 is bent backwards to cause the corresponding (−) side rotate cam follower 65 to move to the second or rear position through the medium of the rotate transmitting member 70 until the lower surface of its rear end is engaged with the upper surface of the rotate output bar 64. The receded cam follower 65 rotates upwards according to the lift amount of the corresponding one of the rotate cams 76–79 and by an amount smaller than the upward rotational movement of the nonselection cam follower 62, so that the rotate output bar 64 rotates upwards by only the said amount. Consequently, the type head 3 is rotated from the (0) character column 7 or 9 to any one of the (−4) to (−1) character columns 7 and 9.

After completion of the required printing operation, the interposer 26 returns forwards, then the receded (−) side rotate cam follower 65 is returned to the first or front position by the biasing force of the spring 69, and at the same time the cam shaft 50 completes one turn and the type head 3 returns to the position in which the (0) character column 7 is confronted to the platen 1.

When the key 23 corresponding to the (0) character column 7 or (+) side type column 7 or 9 is depressed, the (0) rotate cam follower 66 or (+) side rotate cam follower 67 is moved rearwards and its rear end reaches the rotate output bar 64. In this case, the (0) rotate cam follower 66 is not rotated and the (+) side rotate cam follower 67 is rotated downwards by an amount equal to the lift amount of the corresponding one of the rotate cams 81–85, so that the type head 3 is rotated from the (0) position to any one of the (+1) to (5) positions.

Figure 8:
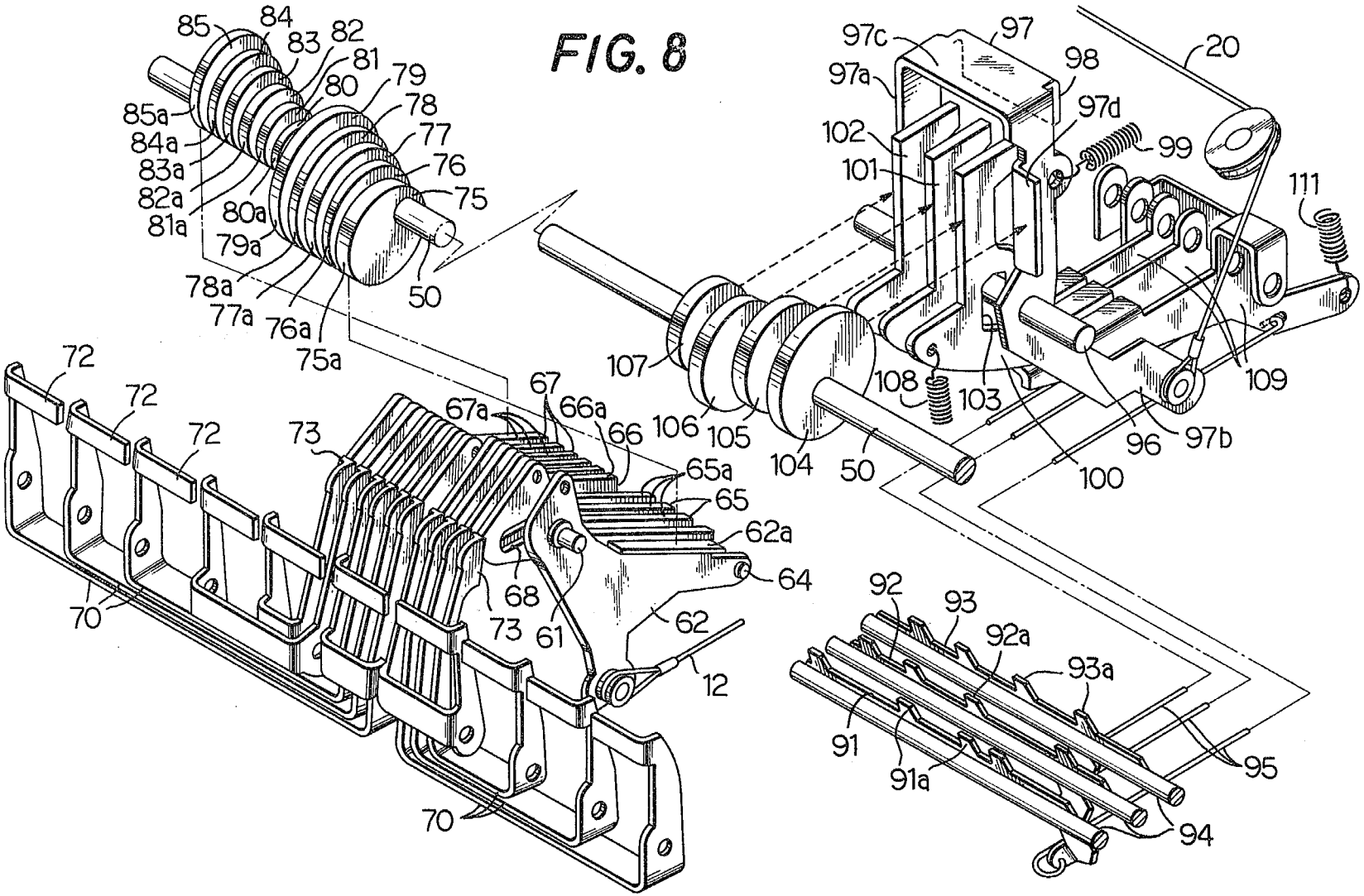
FIG. 8 is an exploded perspective view of a rotation selection mechanism and a tilt selection mechanism.
Figure 9:
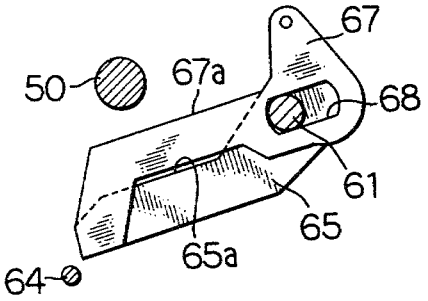
FIG. 9 is a sectional view of (−) side and (+) side rotating cam followers.

Now, an explanation is given about a tilting mechanism for the type head 3. First, second and third code bars 91, 92, 93 are fixed to rotatable supporting shafts 94 which are transversely disposed below the front portions of the interposers 26. As shown in FIGS. 1 and 8, the code bars 91, 92 and 93 are provided with upwardly projecting comb teeth-like lugs 91*a*, 92*a* and 93*a*, respectively. The lugs 91*a*, 92*a* and 93*a* are corresponding to the projections 26*a*, 26*b* and 26*c* of the interposers 26, respectively. One interposer 26 is corresponded to any one lug of the three code bars 91–93 or is corresponded to no lug; one interposer 26 is never corresponded to two or more lugs. Therefore, when the interposer 26 corresponded to the lug 91*a* is depressed and is moved rearwards by the drive plate 34, the projection 26*a* comes into abutment with the lug 91*a*, resulting in the first code bar 91 alone being rotated rearward. Connecting rods 95 are connected at the respective front ends to the lower portions of the right ends of the code bars 91–93.

A tilt supporting shaft 96 is pivotably mounted behind and below the cam shaft 50. Onto the tilt supporting shaft 96, as shown in FIG. 8, are secured left and right leg portions 97*a*, 97*b* of a gate-shaped non-selection cam follower 97. The legs 97*a* and 97*b* are connected together at the top thereof by a connecting portion 97*c* from the rear of which depends a tilt output portion 98. A spring 99 biases the non-selection cam follower 97 in a counterclockwise direction in FIG. 14.

Between the legs 97*a* and 97*b* of the non-selection cam follower 97 are disposed three generally L-shaped tilt cam followers 100–102. In the base portions of the tilt cam followers 100–102 are formed vertically elongated holes 103 through which extends the tilt supporting shaft 96 whereby the tilt cam followers 100–102 are carried by the shaft 96 so as to be movably from a first to a second position in the vertical direction and pivotably.

Onto the cam shaft 50 are secured four tilt cams 104–107 of which, in FIG. 8, the rightmost one is taken to be (−2) tilt cam 104 and the others, in order to the left, are taken to be (−1) tilt cam 105, (+1) tilt cam 106 and (0) tilt cam 107. As shown in FIG. 14, the (−2) tilt cam 104 is confronted to a cam follower portion 97*d* which is formed in the right leg portion 97*b* of the non-selection cam follower 97. To the lower end of the right leg portion 97*b* is connected one end of the tilt string 20. Therefore, the non-selection cam follower 97 is under the load of the spring 19 which biases the tilt link 18, and normally the cam follower portion 97*d* is in abutment with the peripheral cam face of the (−2) tilt cam 104.

The (−1), (+1) and (0) tilt cams 105, 106 and 107 are confronted to the tilt cam followers 100, 101 and 102, respectively, which are biased clockwise (in FIG. 14) about the tilt supporting shaft 96 with a spring 108 to allow cam follower portions 100*a*–102*a* to abut the peripheral cam faces of the corresponding tilt cams 105–107 and to be positioned in the first position shown in FIG. 8. The tilt cam followers 100–102 are constructed so that when they are moved from the first position to the second position along the elongated holes 103 against the biasing force of the spring 108 and are pivoted backwards by the tilt cams 105–107, the rear faces of their upper end portions engage the tilt output portion 98 whereby the non-selection cam follower 97 is pivoted rearwards.

Three tilt transmitting members 109 pivotably mounted on a supporting shaft 110 behind and below the tilt cam followers 100–102. The tilt transmitting members 109 are each provided with an extruding part 109*a* capable of coming into abutment with the lower end of one of the tilt cam followers 100–102 as the tilt transmitting member 109 is rotated counterclockwise in FIG. 14, the extruding part 109*a* being normally held in such an inoperative position by the biasing force of a spring 111.

In the tilt selection mechanism of such a construction, when the interposer corresponding to none of the code bars 91–93 is operated, only the non-selection cam follower 97 is rendered effective and, without being impeded by the tilt cam followers 100–102, it is rotated in a clockwise direction in FIG. 14 by an amount equal to the lift amount of the (−2) tilt cam 104 due to the biasing force of the spring 19, resulting in that the tilt link 18 is rotated clockwise through the medium of the tilt spring 20 whereby the type head 3 is tilted through the medium of connecting rod 17 and tilt member 15 to the position in which the (−2) character row 14 is confronted to the platen 1.

When the interposer 26 corresponding to the first code bar 91 is operated, the rightmost tilt transmitting member 109 is pivoted clockwise against the spring 111 through the medium of the connecting rod 95, allowing the tilt cam follower 100 to rise. As the cam shaft 50 rotates in this condition, the upper end portion of the tilt cam follower 100 comes into engagement with the tilt output part 98, resulting in that the non-selection cam follower 97 which has been controlled by the (−2) tilt cam 104 is pivoted in accordance with the lift amount of the (−1) tilt cam 105; that is, only the (−1) tilt cam 105 is rendered effective. Consequently, the amount of movement of the tilt spring 20 and the rocking amount of the tilt link 18 become almost half of the preceding case mentioned above, so that the type head 3 is tilted so that the (−1) type row 14 comes into confrontation to the platen 1.

Operation of the second and third code bars 92, 93 is also followed by nearly the same operations. When the second code bar 92 is operated, the (+1) tilt cam 106 is rendered effective and the non-selection cam follower 97 is rotated in a counterclockwise direction in FIG. 14 according to the lift amount of the (+1) tilt cam 106, allowing the type head 3 to be tilted so that the (+1) type row 14 confronts the platen 1. On the other hand, when the third code bar 93 is operated, the (0) tilt cam 107 is rendered effective, so that the type head 3 performs no substantial tilting motion, it maintains the confronted condition of the (0) character row 14 to the platen 1.

The shift mechanism for the switching of small character types 6 and large character types 8 is of a construction such that upon depression of a shift key (not shown), the rotate string 12 is moved by an amount necessary for the type head 3 to make a half turn. In FIG. 3, a shifting grooved, rotatable member 112 which guides the rotate string 12 is carried on the machine frame so as to be movable in the direction of stretch of the rotate string 12 (towards the right in FIG. 3). The amount of movement of the pulley 112 is half of the amount of movement of the rotate string 12 necessary to cause a half turn of the type head 3.

In this device, as set forth hereinbefore, rotate cams corresponding to character columns and tilt cams corresponding to character rows are mounted on a cam shaft which is rotated through the medium of a clutch, the clutch being operated by the depression of a key lever, whereby it became possible to provide a type selecting mechanism which is simple in construction and operates positively.

What is claimed is:

1. A character selection mechanism for a typewriter having a single type head with characters arranged in rows and columns thereon comprising:

a plurality of key levers;

a plurality of interposers arranged under said key levers so as to be movable from an original position to a depressed position and to an operative position;

each of said interposers being moveable from the original position to the depressed position upon a depression of each key lever respectively;

a common drive member movably supported under all of said interposers;

a continuously rotating drive shaft;

a clutch;

a cam shaft connected through said clutch to said drive shaft, said cam shaft being rotated once by said drive shaft each time when said clutch is triggered upon movement of said each key lever to its depressed position;

actuating means including a drive cam on said cam shaft for synchronously moving said common drive member with said cam shaft to actuate the depressed interposer toward the operative position;

a series of additional cams fixed on said shaft;

a series of cam followers assigned individually to each of said additional cams and supported so as to be movable between a first position and a second position, spring means for biasing said each cam follower to be in continuous contact with a peripheral cam face of each said additional cam confronts thereto and to be normally held in the first positon;

a series of transmitting members arranged between said interposers and said cam followers, each transmitting member having two ends, one of which confronts several of said interposers corresponding to characters arranged in a column or a row, and the other of which abuts a respective said cam follower;

said each transmitting members being movably supported for moving a respective said cam follower from the first position to the second position against biasing force of the spring means when one of said interposers is moved by said common drive member to the operative position and moves its respective confronted transmitting member;

output means being operatively connectable with only the one of said cam followers which is moved to the second position by a respective said transmitting member and being actuated by a respective said cam follower upon a rotation of a respective said cam corresponding thereto; and connecting means for connecting said output means with said type head to select a character of the type head while said cam follower at the second position is actuated by the rotation of said cam corresponding thereto.

2. A character selection mechanism as defined in claim 1, wherein said series of additional cams comprise a group of rotate cams to select the columns of the type head, and a group of tilt cams to select the rows of the type head, said series of cam followers comprise a group of rotate cams followers corresponding to the group of rotate cams and a group of tilt cam followers corresponding to the tilt cams, and said series of transmitting members comprise a group of rotate transmitting members corresponding to the group of rotate cam followers and a group of tilt transmitting members corresponding to the group of tilt cam followers.

3. A character selection mechanism as defined in claim 2 wherein said output means have two rotatable members, one of which corresponds to the group of the rotate cam followers and the other of which corresponds to the group of the tilt cam followers.

4. A character selection mechanism as defined in claim 2, wherein each of said rotate transmitting members has an abutment part which always contacts said a respective rotate cam follower, and an engaging part engageable with said several interposers.

5. A character selection mechanism as defined in claim 2, wherein said group of rotate cams comprise one cam and two sets of cams, and said one cam has a cam face substantially concentric with said cam shaft in order not to move said cam followers corresponding thereto upon a rotation of the cam and one of said two sets of cams consist of several cams for respectively moving said cam followers corresponding thereto by various distances against a biasing force of the spring means upon a rotation of the cams and the other of two sets of cams consist of several cams for respectively moving said cam followers corresponding thereto by various distances according to the biasing force of the spring means upon a rotation of the cams.

6. A character selection mechanism as defined in claim 2, wherein said group of tilt cams comprise one cam and two sets of cams, and said one cam has a cam face substantially concentric with said cam shaft in order not to move said cam follower corresponding thereto upon a rotation of the cam and one of said two sets of cams consist of a few cams for respectively moving said cam followers corresponding thereto by various distances according to the biasing force of the spring means upon a rotation of the cams and the other of said two sets of cams consist of a few cams for respectively moving said cam followers corresponding thereto by various distances against said biasing force of the spring means upon a rotation of the cams.

* * * * *